United States Patent [19]

Hight

[11] Patent Number: 4,637,461

[45] Date of Patent: Jan. 20, 1987

[54] PATTERNS OF VERTICAL AND HORIZONTAL WELLS FOR IMPROVING OIL RECOVERY EFFICIENCY

[75] Inventor: Margaret A. Hight, Houston, Tex.

[73] Assignee: Texaco Inc., White Plains, N.Y.

[21] Appl. No.: 814,826

[22] Filed: Dec. 30, 1985

[51] Int. Cl.[4] ..... E21B 43/24

[52] U.S. Cl. ..... 166/245; 166/50; 166/263; 166/272

[58] Field of Search ..... 166/50, 245, 263, 272

[56] References Cited

U.S. PATENT DOCUMENTS

| | | | |
|---|---|---|---|
| 3,402,768 | 9/1968 | Felsenthal | 166/263 X |
| 3,476,182 | 11/1969 | Allen | 166/245 |
| 4,020,901 | 5/1977 | Pisio et al. | 166/245 X |
| 4,166,501 | 9/1979 | Korstad et al. | 166/272 X |
| 4,166,503 | 9/1979 | Hall et al. | 166/272 X |
| 4,177,752 | 12/1979 | Brown et al. | 166/245 X |
| 4,283,088 | 8/1981 | Tabakov et al. | 166/272 X |
| 4,303,126 | 12/1981 | Blevins | 166/272 X |
| 4,384,613 | 5/1983 | Owen et al. | 299/2 X |
| 4,390,067 | 6/1983 | Willman | 166/272 X |
| 4,456,065 | 6/1984 | Heim | 166/252 X |

*Primary Examiner*—George A. Suchfield

*Attorney, Agent, or Firm*—Jack H. Park; Kenneth R. Priem; Harold J. Delhommer

[57] ABSTRACT

The disclosed invention is a method of recovering hydrocarbons from an underground formation by employing modified inverted 9 spot and modified inverted 13 spot well patterns which contain substantially horizontal wells completed between the substantially vertically corner and side wells of the invention well patterns.

16 Claims, 2 Drawing Figures

PATTERNS OF VERTICAL AND HORIZONTAL WELLS FOR IMPROVING OIL RECOVERY EFFICIENCY

BACKGROUND OF THE INVENTION

The invention process is concerned with the enhanced recovery of oil from underground formations. More particularly, the invention relates to a method for recovering hydrocarbons with modified inverted 9 spot and modified inverted 13 spot well patterns employing horizontal wells located between the vertical corner and vertical side wells of the patterns.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,283,088 illustrates the use of a system of radial horizontal wells, optionally in conjunction with an inverted 9 spot having an unsually large number of injection wells. U.S. Pat. No. 4,390,067 illustrates a scheme of using horizontal and vertical wells together to form a pentagonal shaped pattern which is labeled a "5 spot" in the patent, although the art recognizes a different pattern as constituting a 5 spot.

SUMMARY OF THE INVENTION

The invention is a method of recovering hydrocarbons from an underground formation by employing modified inverted 9 spot and modified inverted 13 spot well patterns which contain several wells in which at least a portion of the wells extend through the formation in a substantially horizontal direction. Substantially horizontal wells are completed between the substantially vertical corner and side wells of the invention well patterns.

DETAILED DESCRIPTION

Although they are more costly and difficult to drill, horizontal wells offer several advantages over vertical wells. One advantage is the increase in direct contact between the wellbore and the pay zone. The perforated interval per vertical well is limited to the pay zone thickness. But for a horizontal well, the perforated interval could be more than ten times that of a vertical wellbore. For example, a 400 foot horizontal well could be run in a 30 foot thick pay zone.

A second advantage of horizontal wells is the ability to complete several horizontal wells from a single location and cover a large drainage area. This is an important advantage when drilling in offshore, Arctic or environmentally sensitive areas where drill site preparation is a major expense. Thirdly, vertical drilling can be uneconomical in very thin pay zone areas. Properly placed horizontal wells can solve this problem. For certain thin formations with a bottom water table, horizontal wells could defer and reduce water coning by providing a low pressure area over a long distance rather than a single low pressure point as with vertical wells.

A fourth advantage is the ability to inject or produce fluids orthogonal to those from a vertical well. This provides potential of improving sweep efficiency of a flood and therefore increasing recovery efficiency.

However, horizontal wells are significantly more expensive to drill than vertical wells. In addition, all existing hydrocarbon reservoirs have vertical wells which have already been drilled in the reservoirs. Thus, ways must be found to coordinate the use of horizontal wells with existing vertical well patterns.

The invention method provides a way of achieving horizontal well advantages by using substantially horizontal wells in conjunction with substantially vertical wells for improving oil recovery efficiency. The invention requires that eight substantially horizontal wells be drilled and completed between each substantially vertical side well and each substantially vertical corner well of the modified inverted 9 spot. Horizontal wells should be aligned on the substantially rectangular or square boundaries of the modified patterns running between the corner wells.

Formation characteristics and existing vertical wells may require that the pattern be shaped roughly like a quadrilateral without 90 degree angles. Such patterns are intended to be encompassed within the phrase "substantially rectangular pattern".

The horizontal and vertical wells should be drilled in the bottom third, most preferably, the bottom fifth of the hydrocarbon formation to take full advantage of horizontal well production properties and the tendency of thermal fluids to rise in the formation. Care should be taken in the completion of the horizontal and vertical wells to avoid creating direct communication paths between the different wells and to avoid thief zones or large fractures which may exist in the formation between the different wells.

Figure 1:
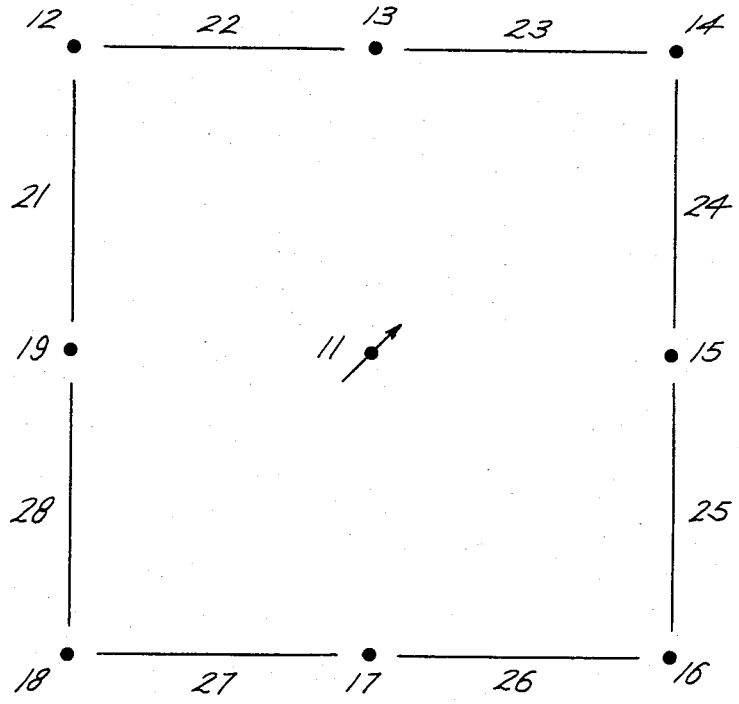
FIG. 1 illustrates the invention well pattern for a modified inverted 9 spot pattern.
Figure 2:
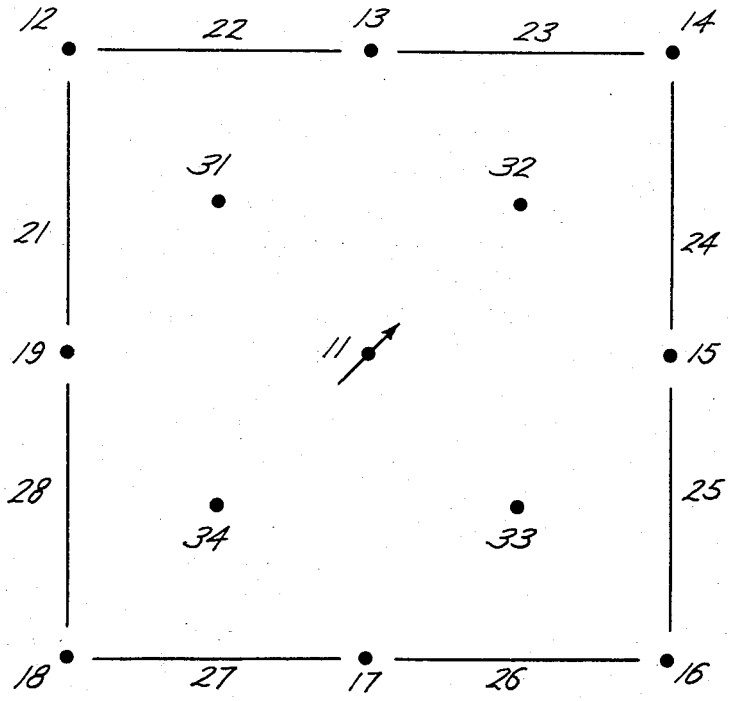
FIG. 2 illustrates the invention well pattern for a modified inverted 13 spot pattern.

FIGS. 1 and 2 diagram the modified inverted 9 spot and modified inverted 13 spot patterns, respectively. In both figures, well 11 is the central injection well. For some patterns, particular patterns covering a large area, it may be desirable to substitute several vertical injection wells for the single injection well 11 and locate the plural central injectors near the center of the pattern.

Wells 12, 14, 16 and 18 are the four substantially vertical corner wells. These corner wells may be injection or production wells, but are preferably production wells. Under certain circumstances, it may be desirable to convert them to injection wells. Wells 13, 15, 17 and 19 are the four substantially vertical side wells, which may be either injection or production wells. Preferably, the side wells are also production wells. Care must be exercised in injecting through the side wells and corner wells because of the close proximity of the horizontal producing wells.

Wells 21, 22, 23, 24, 25, 26, 27 and 28 are all substantially horizontal production wells located between the side and corner wells. The horizontal wells 21 ∝ 28 are all aligned along the substantially rectangular or substantially square boundaries of the modified inverted 9 spot.

Wells 31, 32, 33 and 34 of FIG. 2 are infill wells. The infill wells 31–34 are normally used as production wells, but under some operational procedures, may be converted to injection wells as is well known in the art.

In the most preferred thermal embodiment of the invention as illustrated in FIG. 2, injection of a thermal fluid such as steam is begun at central injection well 11. The production wells are all cyclic stimulated with a thermal fluid prior to being placed on production. Once breakthrough from the central injection well 11 is reached at the infill production wells 31–34, the infill wells 31–34 are converted into injection wells and injection continued at the 5 wells in the interior of the pattern. Production is obtained at all corner wells, side wells and horizontal wells along the substantially rectangular boundaries of the pattern.

Simulation results indicate that the use of horizontal wells in conjunction with vertical wells according to the invention is highly effective in recovering oil, particularly oil from blind spot areas in mature steam floods. The horizontal wells speed oil recovery and thus, shorten project lives. The production capacity of horizontal wells also permits the expansion of pattern size to lower the drilling cost per acre at a minimal cost to recovery efficiency. Although the invention method may be practiced in most hydrocarbon reservoirs, production economics will probably limit its use to thermal recovery in heavy oil reservoirs for the next few years.

Horizontal wells must extend from the surface and run a substantially horizontal distance within the hydrocarbon formation. The diameter and length of the horizontal wells in their perforation intervals are not critical, except that such factors will affect the well spacing and the economics of the process. Perforation size will be a function of factors such as flow rate, temperatures and pressures employed in a given operation. Such decisions should be determined by conventional drilling criteria, the characteristics of the specific formation, the economics of a given situation, and the well known art of drilling horizontal wells.

The following examples will illustrate the invention. They are given by way of illustration and not as limitations on the scope of the invention. Thus, it should be understood that a process can be varied from the description and the examples and still remain within the scope of the invention.

EXAMPLES

A commercially available 3-dimensional numerical simulator developed for thermal recovery operations was employed for the examples. The model used was "Combustion and Steamflood Model-THERM" by Scientific Software-Intercomp. The model accounts for three phase flow described by Darcy's flow equation and includes gravity, viscous and capillary forces. Heat transfer is modeled by conduction and convection. Relative permeability curves are temperature dependent. The model is capable of simulating well completions in any direction (vertical, horizontal, inclined or branched).

Reservoir properties used in the study are typical of a California heavy oil reservoir with unconsolidated sand. A dead oil with an API gravity of 13 degrees was used in the simulation. The assumed reservoir properties are listed in Table 1.

EXAMPLE 1

An 18.5 acre (7.5 ha) inverted 9 spot pattern was used as a basis for this simulation study. The 125-foot (38-m) thick formation is divided into five equal layers. All wells were completed in the lower 60% of the oil sand. Steam at 65% quality was injected into the central well at a constant rate of 2400 BPD (381 $m^3/d$) cold water equivalent. The project was terminated when the fuel required to generate steam was equivalent to the oil produced from the pattern or instantaneous steam-oil ratio (SOR) of 15. A maximum lifting capacity of 1000 BPD (159 $m^3/d$) was assumed for each producing well.

The resulting oil recovery at the end of the project life (15 years) was 64.7% of the original oil in place. The predicted oil saturation profile indicates a good steam sweep throughout the upper three layers to an oil saturation less than 0.2 (the upper 60% of the oil zone), but steam bypassed most of the lower two layers except near the injection well.

EXAMPLE 2

Infill wells were added to the simulation grid midway between center and corner wells to form an inverted 13 spot pattern. The wells were completed in the lower one-third of the zone only and infill well production began after three years of steam injection and continued to the end of the project.

Ultimate recovery was 63.2% of the original oil in place after 11 years. Note that the advantage of infill wells is to recover oil sooner. For the inverted 9 spot pattern of Ex. 1, the oil recovery at 11 years would have been only 57% at this time. Because of the presence of infill wells, oil production which would otherwise arrive at corner and side wells will be reduced. As a result, the inverted 13 spot pattern would reach economic limit much sooner than an inverted 9 spot pattern unless other operational changes are made.

The oil saturation profile for Example 2 is about the same as for Ex. 1, but is reached four years sooner than in Ex. 1. There is still a high oil saturation region in the area between the corner and side wells.

EXAMPLE 3

The modified inverted 13 spot of FIG. 2 was simulated and compared with the base cases of Examples 1 and 2. The run was carried out by simulating one-eighth of an 18.5 acre (7.5-ha) pattern. Example 3 was essentially a repeat of Example 2 except that horizontal well production was begun after six years. Vertical wells were completed in the lower three layers of the simulation grid only and all horizontal wells were completed in the bottom (fifth layer) of the simulation grid. The horizontal wells had a length of 374 feet and a diameter of six inches.

Project life was reduced to a low nine years with an ultimate recovery of 65.9% of the original oil and place. The average oil saturation in the blind spots was reduced from 60% to 30%.

The behavior of the horizontal well production in this pattern was similar to that of the infill well production in that both had a rapid increase in production rate and then declined shortly thereafter. The peak production rates after three years and six years corresponded to the infill production and horizontal well production, respectively. The first year of horizontal well production caused a 250% increase in the annual oil production rate for the pattern.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

TABLE 1

| RESERVOIR AND FLUID PROPERTIES - SIMULATION OF EXAMPLES 1–4 | | |
|---|---|---|
| Porosity, fraction | | 0.39 |
| Initial Fluid Saturations, Fraction: | | |
| Oil | | 0.589 |
| Water | | 0.411 |
| Gas | | 0 |
| Initial Reservoir Temperature, °F. (°C.) | | 100 (37.7) |
| Initial Reservoir Pressure, psi (kPa) | | 50 (345) |
| Permeability, md: | | |
| Horizontal ($\mu m^2$) | | 3000 (3) |
| Vertical ($\mu m^2$) | | 900 (0.9) |
| Reservoir Thermal Conductivity, Btu/day-ft-°F. (W/m-°C.) | | 31.2 (2.25) |
| Reservoir Heat Capacity, Btu/ft$^3$-°F. (kJ/m$^3$-°C.) | | 37.0 (2481) |
| Cap and Base Rock Thermal Conductivity, Btu/day-ft-°F. (W/m-°C.) | | 24.0 (1.73) |
| Cap and Base Rock Heat Capacity, Btu/ft$^3$-°F. (kJ/m$^3$-°C.) | | 46.0 (3085) |
| Oil Viscosity, | cp @ °F. | Pa.s @ °C. |
| | 1230 @ 100 | 1.23 @ 37.7 |
| | 10 @ 300 | 0.01 @ 148.9 |
| | 3.99 @ 400 | 0.00399 @ 204.4 |
| Quality of Injected Steam, fraction (at sand face) | | 0.65 |
| Residual Oil Saturation, Fraction | | |
| to water: | | 0.25 |
| to steam: | | 0.15 |

What is claimed is:

1. A method of recovering hydrocarbons from an underground formation by employing a modified inverted 9 spot well pattern, which comprises:
   a substantially vertical central injection well;
   four substantially vertical corner wells;
   four substantially vertical side wells, each located between two corner wells; and
   eight substantially horizontal production wells, each located between one of the side wells and one of the corner wells, said horizontal production wells extending from the ground surface and running a substantially horizontal distance within the hydrocarbon formation,
   said horizontal wells aligned on the substantially rectangular boundaries of the modified inverted 9 spot running between the corner wells.

2. The hydrocarbon recovery method of claim 1, wherein the corner wells are production wells.

3. The hydrocarbon recovery method of claim 2, wherein the corner wells are cyclic stimulated with a thermal fluid prior to being placed on production.

4. The hydrocarbon recovery method of claim 1, wherein the the side wells are production wells.

5. The hydrocarbon recovery method of claim 4, wherein the side wells are cyclic stimulated with a thermal fluid prior to being placed on production.

6. The hydrocarbon recovery method of claim 1, wherein the corner wells are injection wells.

7. The hydrocarbon recovery method of claim 1, wherein the side wells are injection wells.

8. The hydrocarbon recovery method of claim 1, wherein the horizontal wells are completed in the bottom fifth of the formation.

9. The hydrocarbon recovery method of claim 1, wherein the vertical wells are completed in the bottom fifth of the formation.

10. The hydrocarbon recovery method of claim 1, wherein there are no direct communication paths between any of the horizontal and vertical wells.

11. The hydrocarbon recovery method of claim 1, further comprising an additional substantially vertical central injection well.

12. The hydrocarbon recovery method of claim 1, further comprising four substantially vertical infill wells located between the central injection well and the four corner wells.

13. The hydrocarbon recovery method of claim 12, wherein the infill wells are production wells.

14. The hydrocarbon recovery method of claim 12, wherein the infill wells are injection wells.

15. A method of recovering hydrocarbons from an underground formation by employing a modified inverted 9 spot well pattern, which comprises:
   a substantially vertical central injection well;
   four substantially vertical corner production wells;
   four substantially vertical side production wells, each located between two corner wells; and
   eight substantially horizontal production wells, each located between one of the side wells and one of the corner wells, said horizontal production wells extending from the ground surface and running a substantially horizontal distance within the hydrocarbon formation,
   said horizontal wells aligned on the substantially rectangular boundaries of the modified inverted 9 spot running between the corner wells,
   all wells being completed in the bottom fifth of the formation.

16. The hydrocarbon recovery method of claim 15, further comprising four substantially vertical infill wells located between the central injection well and the four corner wells.

* * * * *